US005540636A

United States Patent [19]

Hellen

[11] Patent Number: 5,540,636

[45] Date of Patent: Jul. 30, 1996

[54] PLAYGROUND JUNCTION BALL

[75] Inventor: Russell W. Hellen, Charlotte, N.C.

[73] Assignee: Soft Play, Inc., Charlotte, N.C.

[21] Appl. No.: 225,188

[22] Filed: Apr. 8, 1994

[51] Int. Cl.[6] ..... A63B 17/00

[52] U.S. Cl. ..... 482/35; 482/36; D21/242

[58] Field of Search ..... 403/27; 119/15; 482/35, 36, 38, 37; 285/911, 93; 446/476; D20/108, 2, 119, 160; D21/244, 243; 52/73

[56] References Cited

U.S. PATENT DOCUMENTS

| | | | |
|---|---|---|---|
| D. 218,455 | 8/1970 | Dattner . | |
| D. 218,460 | 8/1970 | Dattner . | |
| D. 218,765 | 9/1970 | Dattner | D34/5 |
| D. 308,562 | 6/1990 | Pentes | D21/242 |
| D. 344,121 | 2/1994 | Warren | D21/243 |
| 1,125,642 | 1/1915 | Blanchard . | |
| 1,939,987 | 12/1933 | Klomparens . | |
| 2,581,047 | 1/1952 | Salmond . | |
| 3,151,869 | 10/1964 | Butcher | 285/991 |
| 3,632,109 | 1/1972 | Dattner . | |
| 3,730,522 | 5/1973 | Paczkowski . | |
| 3,859,961 | 1/1975 | Willinger et al. | 119/15 |
| 3,895,796 | 7/1975 | Pestalozzi . | |
| 3,955,328 | 5/1976 | Lindsay | 52/73 |
| 5,186,122 | 2/1993 | Phillips . | |
| 5,205,748 | 4/1993 | Petersheim . | |
| 5,226,864 | 7/1993 | Showers . | |
| 5,387,165 | 2/1995 | Warren | 446/476 |

*Primary Examiner*—Jerome Donnelly
*Attorney, Agent, or Firm*—Ralph H. Dougherty, P.A.

[57] ABSTRACT

A junction ball for connecting two passageways in a modular playground at any desired angle utilizing two rotatably interlocking hollow half spheres having one access port each. The halves are adapted to be fitted together, rotated to produce the proper angle, and locked into place. A single half may be used for terminating a passageway in conjunction with a viewing dome. The modular half spheres are preferably molded in one piece from plastic. The spherical view port is preferably constructed from polycarbonate. These components are supported by and mounted into a standard pipe structure consisting of pipe and assorted clamps.

7 Claims, 2 Drawing Sheets

PLAYGROUND JUNCTION BALL

FIELD OF THE INVENTION

The present invention relates to playground equipment having a type of construction which permits children to exercise their climbing and pulling desires, safely and leisurely. The invention particularly deals with multi-level playground houses which, while generally enclosed, provide a plurality of compartments which are interconnected with passageways to provide enclosed, multi-directional mazes between entrances and exits designed to allow children, under view of their guardians, to rest, play, exercise, interact and learn. The invention more particularly deals with multi-level, modular grid playground pieces and apparatus for interconnecting the pieces.

BACKGROUND OF THE INVENTION

Most children are possessed of the innate desire to climb and explore new settings. Modular playgrounds have been created to satisfy this desire in children, while retaining that degree of safety necessary to reassure their guardians. They typically consist of modular blocks, compartments and passageways attached together to form a series of maze-like vertical columns and horizontal decks. These playgrounds are typically surrounded by netting, or the like, to provide visual access to the interior of structure. Individual passageways and compartments are typically provided with portholes to provide visual access even in those closed in areas. This eases the fears of children "lost" in the maze and allows guardians to keep their charges in sight at all times.

One of the exciting features of these heretofore known systems is that they are constructed on a multi-level basis with a series of interconnecting passageways, thus allowing the playing children access to higher vistas in a much safer setting than a standard slide or metal jungle-gym. These passageways are typically cylindrical in shape, having no sharp edges to reduce injuries. However, providing these new vistas safely is an on-going goal that has proved to be difficult to accomplish in a manner allowing for the mass production of interchangeable and interconnectable components. Further, apparatus designed to connect such playground passageways at various angles and configurations to provide a maze like structure in a safe efficient manner has not heretofore been available.

The obvious solution would be to provide a separate corner piece for each type of corner that is needed. This has the effect of increasing design and implementation costs to a level that severally limits the range of corner pieces, and thus playground layouts, that are available for use. Several systems have solved this problem by using a sphere or cube, or other multi-sided structure fitted with access ports on each face. The designer then simply closes off the ports not needed in each specific implementation. This structure, while providing a single standard junction box, has unnecessary cost associated with it in terms of space consumed and material required to close off unused ports. Further, the outside appearance of these cubes or spheres is typically unattractive.

It would be advantageous to provide a standard junction apparatus which occupies a smaller foot print and is more economical to construct than individual specialized corner pieces. It would also be advantageous to provide a single playground module that is useful in a variety of situations and serves multiple functions. However, heretobefore known standard junction boxes have proven to be an ineffective solution in that their shape is not conducive to integration in a modular system. Further, the cost in time and parts required to construct such known boxes is excessively high for the function derived from them. Specifically, they do not lend themselves to easy installation, modular utility or to producing an attractive playground unit.

DESCRIPTION OF THE PRIOR ART

Applicants are aware of the following U.S. Patents concerning apparatus relevant to the invented junction ball.

| U.S. Pat. No. | Issue Date | Inventor | Title |
|---|---|---|---|
| 1,125,642 | 01-19-1915 | Blanchard | ADJUSTABLE COUPLING |
| 1,939,987 | 12-19-1933 | Klomparens | ADJUSTABLE ELBOW FOR FURNACES |
| 2,581,047 | 01-01-1952 | Salmond | PIPE COUPLING |
| 3,632,109 | 01-04-1972 | Dattner | MODULAR RECREATIONAL UNIT AND COMBINATIONS THEREOF |
| 3,730,522 | 05-01-1973 | Paczkowski | CHILDREN'S ROCKING AND CLIMBING TOY |
| 3,895,796 | 07-22-1975 | Pestalozzi | TOY AND SPORTS DEVICE |
| 5,186,122 | 02-16-1993 | Phillips | SMALL ANIMAL LIVING ENVIRONMENT SYSTEM |
| 5,205,748 | 04-27-1993 | Petersheim | PLAY APPARATUS HAVING OBSTACLES |
| 5,226,864 | 07-13-1993 | Showers | PLAYGROUND MAZE APPARATUS |
| Design Patents: | | | |
| Des. 218,455 | 08-18-1970 | Dattner | PLAYGROUND CLIMBER |
| Des. 218,460 | 08-18-1970 | Dattner | COMBINED PLAYGROUND CLIMBER AND SLIDE |
| Des. 218,765 | 09-22-1970 | Dattner | COMBINED PLAYGROUND CLIMBER AND SLIDE |

Blanchard, U.S. Pat. No. 1,125,642, shows an adjustable coupling for use in a fire hose nozzle tip to permit a fluid stream to be thrown at various angles. The two halves of the coupling are connected, and are adjusted to any angular relation, by screwing a threaded sleeve onto a threaded flange.

Klomparens, U.S. Pat. No. 1,939,987, teaches an elbow joint for a furnace, comprised of two parts made of sheet metal, joined by snapping a lip on one edge into a groove on the other edge.

Salmond, U.S. Pat. No. 2,581,047, discloses pipe coupling having two parts with integral tubular pipe held together by means of an internally threaded union to allow the passage of fluids.

Dattner, U.S. Pat. No. 3,632,109, discloses a hollow cuboctahedron recreational unit with multiple openings for access to the interior.

Paczkowski, U.S. Pat. No. 3,730,522, teaches a recreational unit comprising a hollow body with a curved outer surface to allow rocking of the body, with openings to allow access to the interior of the unit.

Pestalozzi, U.S. Pat. No. 3,895,796 teaches a twisted or coiled tubular plastic structure made of segments that can rotate relative to one another at their connections. The connection of two structures is via a raised bead around the end of one tube placed into a groove around the end of the adjoining tube.

Phillips, U.S. Pat. No. 5,186,122, shows curved and elbow tubing made of transparent thermoplastic. The connection of tubes is via a linking lip and a ring.

Petersheim, U.S. Pat. No. 5,205,748, teaches a tunnel structure recreational toy made of polyvinyl chloride. Tunnel connections are made by overlapping the edges of the ends of adjacent tube sections.

Showers, U.S. Pat. No. 5,226,864 teaches crawl tunnels with bends and clear domes.

The Dattner U.S. Design Pat. Nos. 218,455, 218,460 and 218,765 show bulbous units interconnecting crawl tunnels.

SUMMARY OF THE INVENTION

The invention provides apparatus for connecting two playground passageways at any desired angle utilizing two rotatably interlocking hollow half spheres having one access port each. When constructing the playground the halves are fitted together, rotated to produce the proper angle, and locked into place. The invention further provides for terminating a passageway with a spherical view port utilizing one of the half spheres and a viewing dome. The modular half spheres are preferably molded in one piece using linear medium density polyethylene. The spherical view port is preferably constructed from polycarbonate, such as marketed under the trademark LEXAN. These components are supported by and mounted into a standard pipe structure consisting of pipe and assorted clamps.

OBJECTS OF THE INVENTION

The principal object of the present invention is to provide improved playground apparatus for children.

Another object of the invention is to provide modular junction spheres for connecting passageways in playground apparatus.

A further object of this invention is to provide a junction ball that can be readily assembled and provide a wide variety of angles between the entry and exit ports.

Another object of the invention is to provide an enclosed observation deck having visual access to the outside.

Another object of the invention is to provide an enclosed platform climbing apparatus which provides only that access specified by the component design and prevents improper use of any component.

Another object of the invention is to provide an economical modular component adapted for serving a variety of functions in a modular playground setting.

Another object of the invention is to provide a modular component that can be separated into halves and nested together or stacked for compact storage.

BRIEF DESCRIPTION OF THE DRAWINGS

The foregoing and other objects will become more readily apparent by referring to the following detailed description and the appended drawings in which.

DETAILED DESCRIPTION

Figure 1:
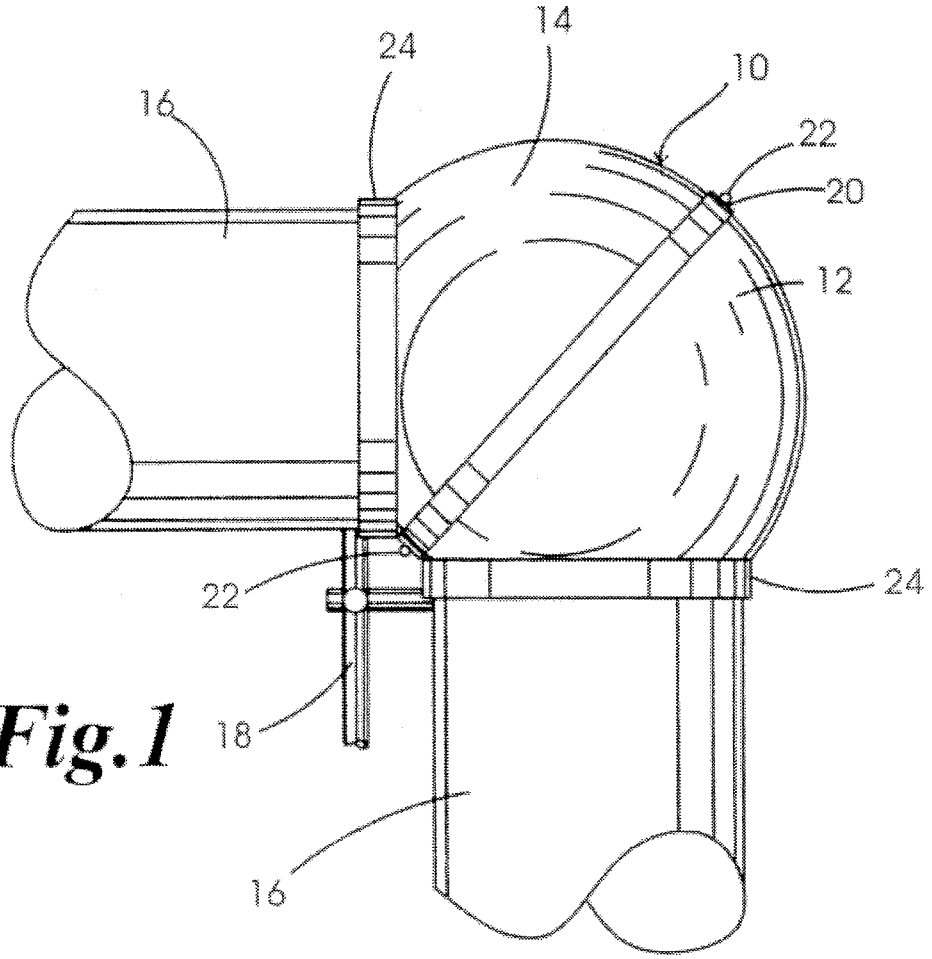
FIG. 1 is a top elevational view of the invented ball joint.
Figure 2:
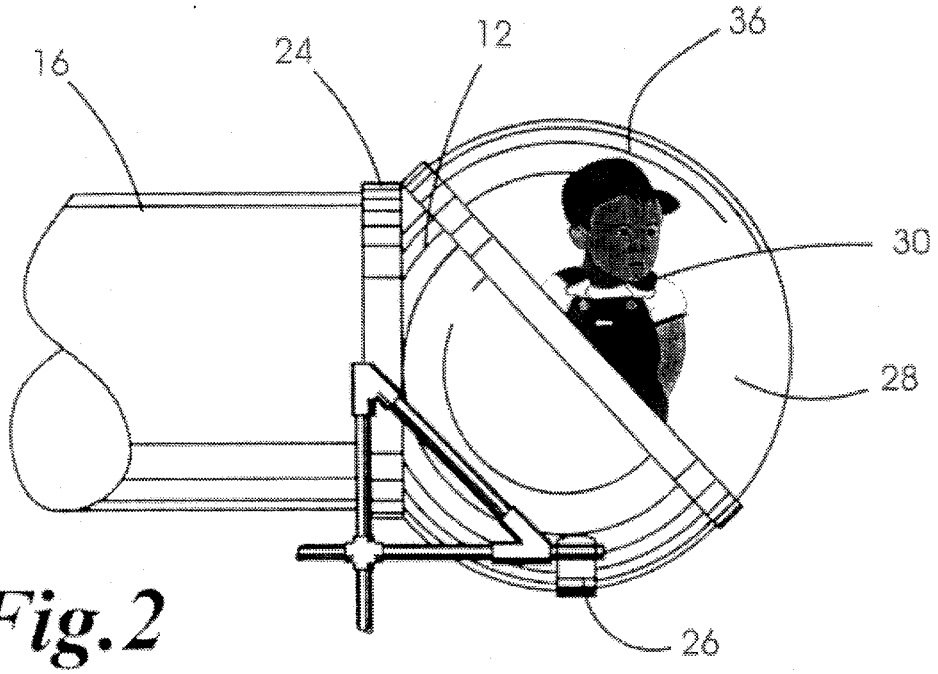
FIG. 2 is a side elevational view of an alternative orientation of the invented ball joint as an observatory.
Figure 3:
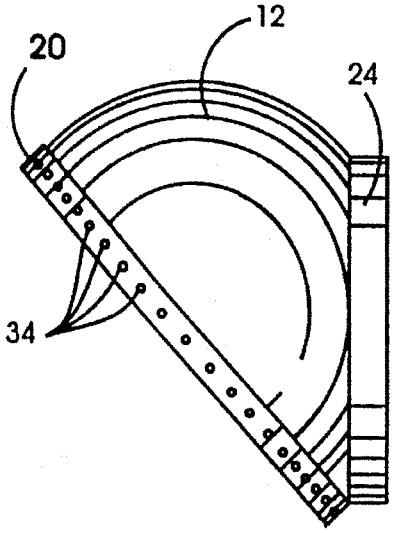
FIG. 3 is a side view of the female ball joint component.
Figure 4:
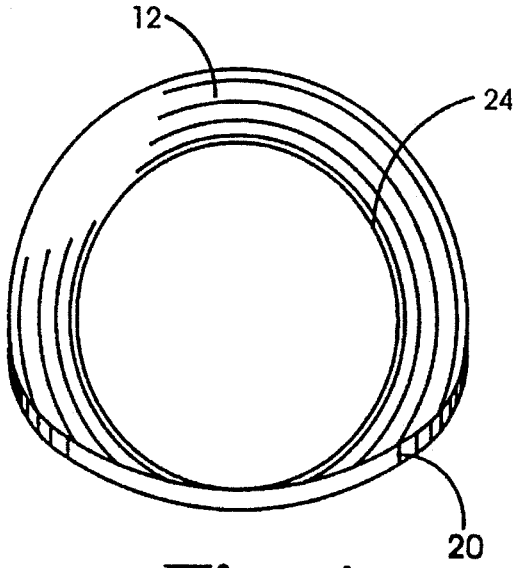
FIG. 4 is an isometric view of the female ball joint component.
Figure 5:
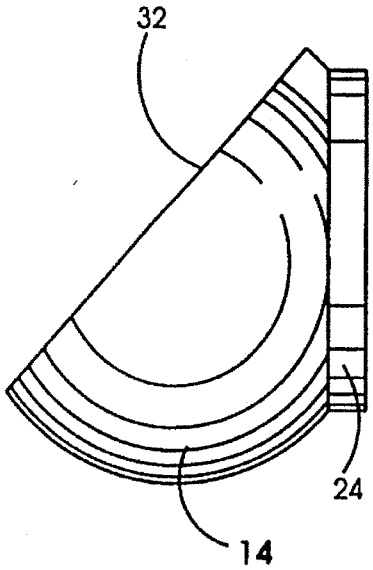
FIG. 5 is a side view of the male ball joint component.
Figure 6:
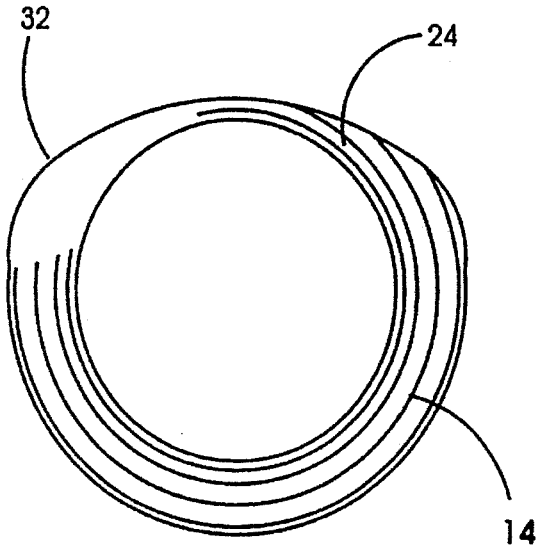
FIG. 6 is an isometric view of the male ball joint component.

Referring now to the drawings, and particularly to FIG. 1, the invented ball joint 10 principally comprises two components 12 and 14 preferably molded from plastic. A suitable plastic is linear medium density polyethylene. The first component 12 is substantially hemispheroidal in shape and is hollow. About its periphery, component 12 has a female receiving flange 20. A socket 24, for connecting ball joint 10 to passageway 16, extends outwardly from component 12. Passageway 16 is typically cylindrical in shape, but, as one skilled in art will recognize, could be any shaped hollow tube or cavern. The axis of socket 24 is radially disposed in relation to the periphery of component 12 and lies at or about 45 degrees from the plane defined by the perimeter of the component 12. The second component 14 is substantially similar in size and shape to component 12, except that it is provided with a male flange 32 having an outer diameter slightly less that the inner diameter of the receiving flange 20 on component 12. Due to their hemispheroidal structure, components 12 and 14 are well suited for stacking or nesting inside one another to facilitate shipping or storage.

In the preferred embodiment correct alignment and coupling of the components 12 and 14 is accomplished via indents 34, placed every 5 degrees about the periphery of receiving flange 20. Using indents 34 as a visual indicator of the angle between the sockets, component 14 is fitted into component 12. When the correct angle is achieved, several holes are drilled using the indents as starters. The halves are then fixed into place using bolts 22. Alternatively, the halves can be welded or bonded together to form the necessary connection. Ball joint 10 is well suited for integration into a pipe frame playground structure 18, but any supporting means can be utilized.

In addition to their use in the ball joint 10, either component 12 or 14 can be used to construct an observatory 36 providing a child 30 with a panoramic vista of the outside world. To create such observatory, a simple polycarbonate dome 28 is fitted onto either half of the ball joint which can be supported by a cantilever bracket or a hanging saddle assembly.

ALTERNATIVE EMBODIMENTS

Due to the modular nature of the invention, the user can construct endless alternative arrangements using the basic pieces. The modularity also lends itself to creating custom configurations for installation in a variety of situations. The components can be mixed and matched to provide different configurations and color variations suitable for integration into varying structures. For example, several components can be connected to provide twisted paths that lead back and forth between the pipe frames.

SUMMARY OF THE ACHIEVEMENT OF THE OBJECTS OF THE INVENTION

From the foregoing, it is readily apparent that I have invented a junction ball which allows its connection to passageways at varying angles, that is constructed from modular pieces which are capable of a variety of configurations, which can be entered and exited by a person at various angles, which can be adapted to provide visual access to the outside, which provides only that access specified by the component design, which prevents improper use of the component, and which is economical.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A modular playground component kit, the components of which are of sufficient size to allow a person to move thereinto or therethrough, comprising:

a hollow tubular modular playground component, having a longitudinal axis and an end, the plane of which end is normal to said longitudinal axis;

a first hollow hemispheroidal mating member, having an interior and an exterior rounded surface and a connecting flange, said member being provided with an opening therethrough surrounded by said connecting flange which extends outwardly from said exterior surface and is adapted to mate with the end of said tubular component;

said first mating member having a second flange, said second flange being circular and adapted to receive a circular portion of a second modular playground component;

said second flange being disposed at or about 45 degrees from said connecting flange;

a second modular playground component selected from the group consisting of:

A. a hollow transparent hemispheroidal dome adapted to be received within said second flange of the first hollow hemispheroidal mating member; and B. a second hollow hemispheroidal mating member, having an interior and exterior surface, said second mating member being transparent and provided with an opening therethrough surrounded by a connecting flange extending outwardly from said exterior surface and adapted to mate with the end of a second tubular component; said second mating member having a mating circular connecting rim adapted to be received within said second flange of the first hollow hemispheroidal mating member; said circular connecting rim being disposed at or about 45 degrees from said connecting flange of said second mating member; and means for fixably connecting said end of said tubular modular playground component to said connecting flange of said first mating member.

2. A coupling according to claim 1, further comprising means for fixably connecting said circular connecting rim to said second flange of said first mating member.

3. A coupling according to claim 1 wherein the means for fixably connecting is a plurality of bolts.

4. A coupling according to claim 1 wherein the means for fixably connecting is welding.

5. A coupling according to claim 1 wherein said hollow tubular modular playground component is cylindrical.

6. A coupling according to claim 1 wherein the first hollow hemispheroidal mating member is transparent.

7. A coupling according to claim 1 wherein said dome is configured from a transparent polycarbonate.

* * * * *